United States Patent [19]

Herring, Jr.

[11] Patent Number: 4,932,330

[45] Date of Patent: Jun. 12, 1990

[54] PRIMARY SUSPENSION SYSTEM FOR A RAILWAY CAR

[75] Inventor: James M. Herring, Jr., Merion Station, Pa.

[73] Assignee: Bombardier Corporation, Bensalem, Pa.

[21] Appl. No.: 904,724

[22] Filed: Sep. 8, 1986

Related U.S. Application Data

[63] Continuation of Ser. No. 788,506, Oct. 18, 1985, abandoned, which is a continuation of Ser. No. 522,758, Aug. 12, 1983, abandoned.

[51] Int. Cl.[5] ..... B61F 5/30

[52] U.S. Cl. ..... 105/224.1; 105/220

[58] Field of Search ..... 105/220, 224.1, 218.1, 105/224.05

[56] References Cited

U.S. PATENT DOCUMENTS

| | | | |
|---|---|---|---|
| 2,047,248 | 7/1936 | Buchman | 105/220 |
| 2,286,563 | 6/1942 | Mussey | 105/224.1 |
| 3,606,295 | 9/1971 | Appleton | 105/224.1 X |
| 4,416,203 | 11/1983 | Sherrick | 105/224.1 |

FOREIGN PATENT DOCUMENTS

| | | | |
|---|---|---|---|
| 746640 | 5/1943 | Fed. Rep. of Germany | 105/218 |

*Primary Examiner*—Andres Kashnikow
*Assistant Examiner*—Mark T. Le
*Attorney, Agent, or Firm*—Dann, Dorfman, Herrell and Skillman

[57] ABSTRACT

A primary suspension system includes a pair of spaced vertical springs connected between a journal bearing retainer and a side frame of a railway truck. Pairs of angularly disposed elastomeric springs are also connected between a lower support housing and opposite angular ends of the journal bearing retainer to provide lateral and longitudinal stiffness.

1 Claim, 3 Drawing Sheets

FIG. 1
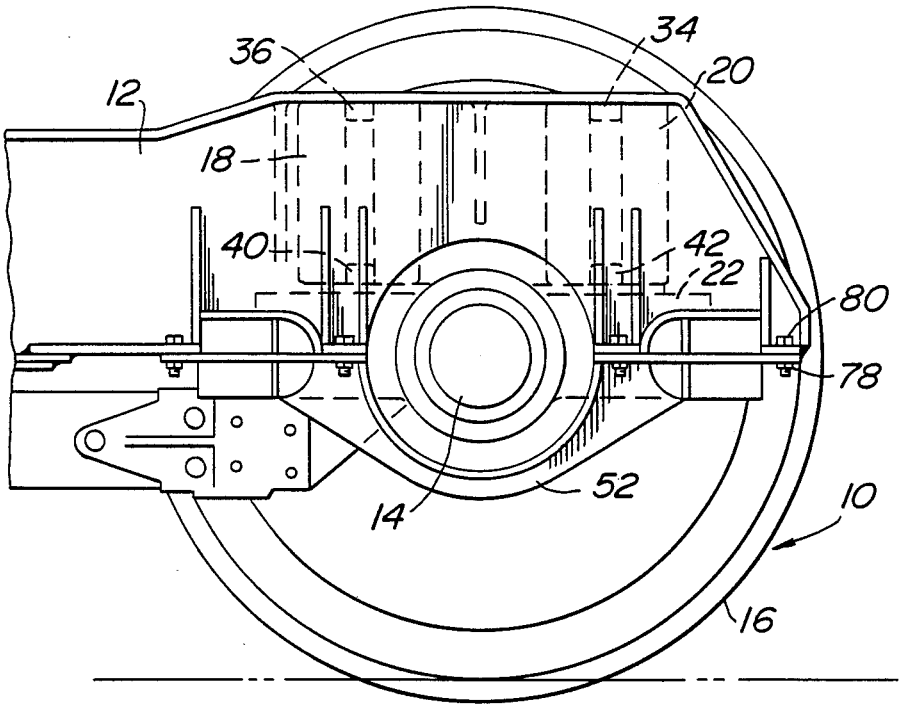
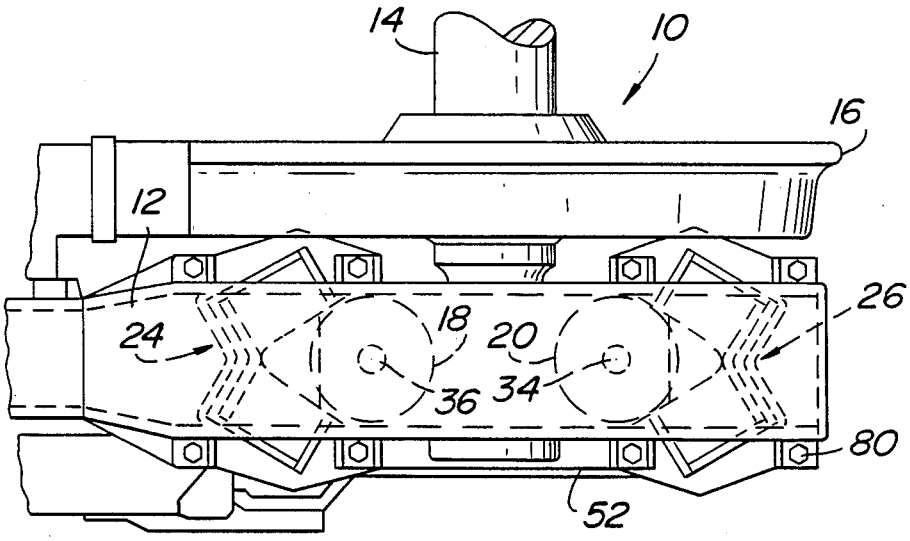
FIG. 2

PRIMARY SUSPENSION SYSTEM FOR A RAILWAY CAR

This is a continuation of application Ser. No. 788,506, filed Oct. 18, 1985, which is a continuation of application Ser. No. 522,758, filed Aug. 12, 1983.

BACKGROUND OF THE INVENTION

In a railway car, the primary suspension system generally refers to the suspension between the journal bearing assembly and the truck frame. The journal bearing assembly carries a wheel axle unit and acceleration forces generated by the wheel are directed to the primary suspension system with the forces being transmitted through the primary suspension system to the side frame. The secondary suspension system refers to the system between a bolster on the truck and the car body and generally include air or mechanical springs. The present invention is directed to primary suspension systems.

Past primary suspension systems have involved elastomeric rings surrounding the journal bearings. Such rings have included cut-away portions to provide softer spring rates and the cut-away portions were designed to provide desired vertical, longitudinal and lateral spring rates. Some of the primary suspension systems used heretofore are described in a patent to Egert 4,044,689, issued Aug. 30, 1977 and in a copending application, assigned to the same assignee as the present invention, of Eggert entitled "Primary Suspension System for a Railway Car", Ser. No. 348,446, patent no. 4,438,703 filed Feb. 12, 1982.

While the aforementioned systems have proven satisfactory for many applications, the spring elements are subject to wear. Also, the vertical, lateral and longitudinal spring rates are generally related to each other and cannot be independently adjusted.

OBJECTS OF THE INVENTION

It is an object of this invention to provide an improved primary suspension system for a truck on a railway car.

It is a further object of this invention to provide an improved primary suspension system having no wear surfaces.

It is still a further object of this invention to provide an improved primary suspension system in which the spring rates for different directions may be independently controlled.

It is still a further object of this invention to provide an improved primary suspension system in which the main parts may be assembled or reparied in areas away from the truck.

BRIEF SUMMARY OF THE INVENTION

In accordance with the present invention, a primary suspension system includes a journal bearing retainer for receiving a journal bearing connected to the axle of a wheel axle unit. A pair of spaced elastomeric or coil springs are connected between the journal bearing retainer and side frame of a truck to provide vertical springing. Two pairs of angularly spaced elastomer spring elements are disposed on opposite ends of the vertical springs to provide lateral and longitudinal springing.

Other objects and advantages of the present invention will be apparent and suggest themselves to those skilled in the art from a reading of the following specification and claims, taken in conjunction with the accompanying drawings.

BRIEF DESCRIPTION OF THE DRAWINGS

FIG. 1 is a side view of a portion of the side frame of a railway truck including the primary suspension system, in accordance with the present invention;

FIG. 2 is a top view of the portion of the truck illustrated in FIG. 1.

DETAILED DESCRIPTION OF THE PREFERRED EMBODIMENTS

Figure 3:
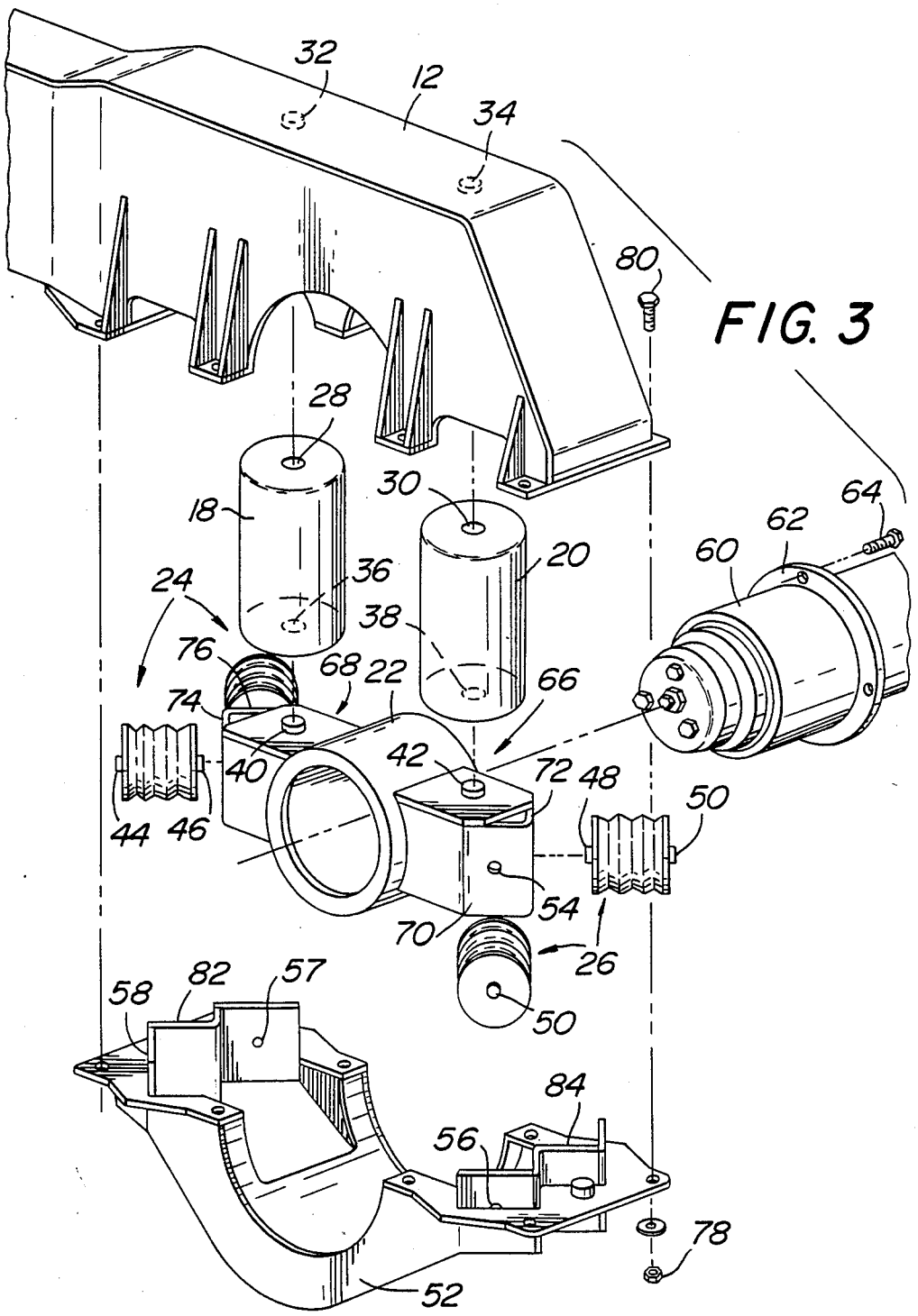
FIGS. 3 and 4 are isometric exploded views of the elements of the primary suspension system, in accordance with the present invention.

Referring to FIGS. 1 and 2, a typical railway truck includes wheel-axle units, such as wheel-axle unit 10, suitably attached to a pair of side frames such as the side frame 12. The wheel axle unit 10 includes an axle 14 and a wheel 16.

The primary suspension system of which the present invention is related includes a pair of spaced vertical springs 18 and 20 which may be elastomeric or mechanical coils, secured to a journal bearing retainer 22. Pairs of angularly disposed spring members 24 and 26 are also connected to the journal bearing retainer 22 and on opposite sides of the springs 18 and 20.

Various elements associated with a typical truck are also illustrated. However, because they are only incidentally related to the present invention, they will not be discussed in detail. The present invention involves the primary suspension system which includes the springs 18, 20 , 24 and 26. This system will be described in detail in connection with FIGS. 3 and 4.

Figure 4:
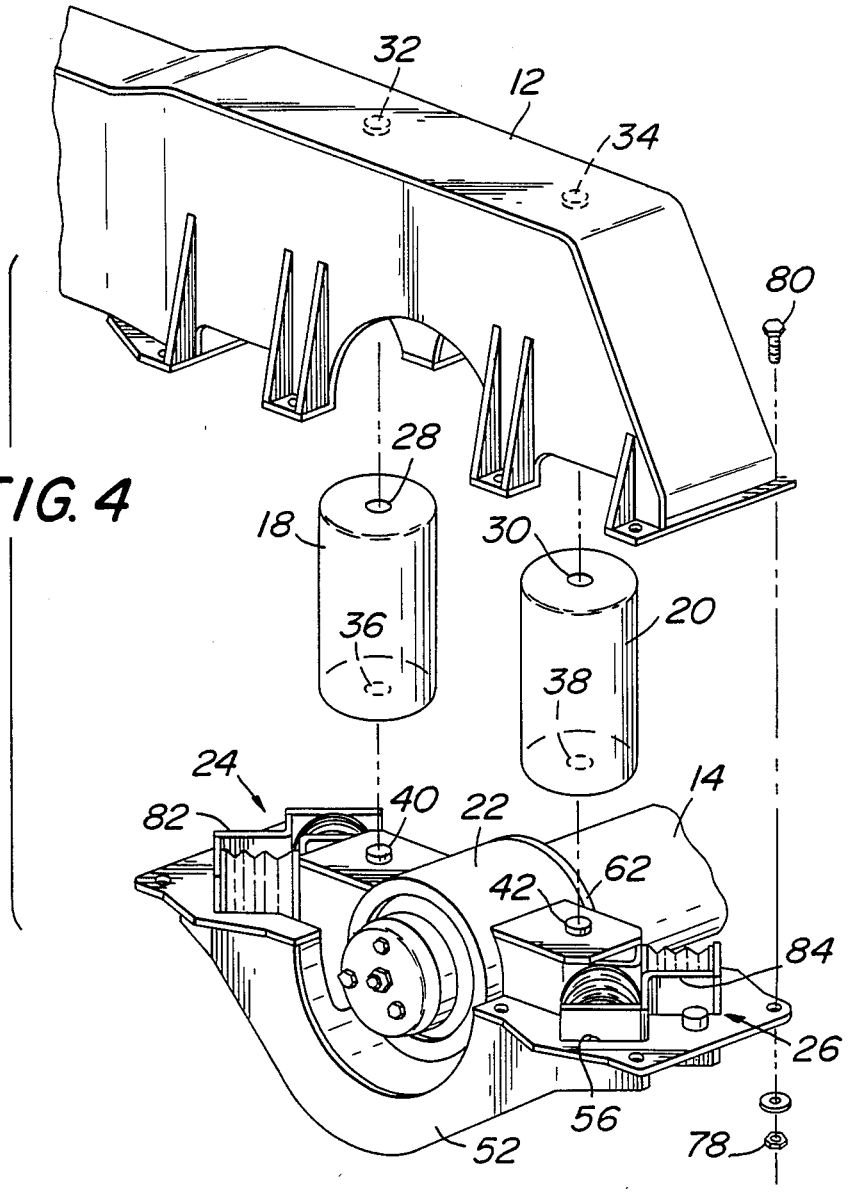

FIGS. 3 and 4 are somewhat similar, with FIG. 3 showing the various parts completely disassembled whereas FIG. 4 shows most of the parts assembled.

Referring to FIGS. 3 and 4, the vertical springs 18 and 20, which may be elastomeric or coil type springs, include top openings 28 and 30 adapted to receive pin-like elements 32 and 34 within the side frame 12. In like manner, the bottom of the springs 18 and 20 include openings 36 and 38 adapted to receive pins 40 and 42 respectively. The purpose of the various openings and pins is to guide the springs 18 and 20 and to maintain it in place within the side frame 12 so that when they expand and contract, they will not rub against the side frame.

The pair of springs 24 each include pin like elements 44 and 46. The pair of springs 26 likewise include end pin-like elements 48 and 50. In an assembled position, the various pins are disposed to enter openings in the journal bearing retainer 22 and lower support housing 52. Only one such opening for receiving the pins 48 is illustrated in FIG. 3, this being the opening 54. If required, shims may be added to provide tram in the bearing retainer 22. The pin elements 50 are disposed to enter into a pair of openings of which only the opening 56 is illustrated in FIG. 3. The lower support housing 52 also includes a portion having openings 57 and 58 for receiving the pin elements 44 of the springs 24.

The journal bearing retainer 22 comprises a central portion for receiving the journal bearing assembly 60. A retainer ring 62 is provided to permit the attachment of the journal bearing to the journal bearing retainer 22 by means of a plurality of screws such as the screw 64.

The journal bearing retainer 22 includes section 66 and 68 extending therefrom. The section 66 includes angular portions 70 and 72 and the section 68 includes angular portions 74 and 76.

The lower support housing 52 is adapted to receive the journal bearing retainer 22 and the various connected parts and is adapted to be connected to the side frame 12 in a well known manner by means of nuts and bolts 78 and 80, for example. The lower support housing 52 includes end angular sections 82 and 84 adapted to receive the pins of the pairs of springs 24 and 26. In operation, these springs are generally installed in a compressed condition. The pairs of springs 24 and 26 are basically elastomeric members having metal strips therein at spaced intervals. This provides the necessary shearing and compression in accordance with the design of this system.

One of the main advantages of the primary suspension system illustated is that there are no wear surfaces. All the motions taking place in the primary suspension system are taken up with the shearing and/or compression of the various control springs including the vertical springs 28 and 30 and the pairs of angularly disposed springs 24 and 26.

A second advantage in the present invention is that the various spring rates for the vertical springs 18 and 20, horizontal springs 24 and 26 may be independently controlled. For example, the characteristics of the springs 18 and 20 may be changed by the composition of the material used. The spring rates of the springs 24 and 26 may be controlled by changing the angles of the spring. The angular positions of the pairs of springs 24 and 26 provide the spring rates for both the lateral and longitudinal directions.

Another feature of the present invention is that the subassembly illustrated in FIG. 4, which includes the lower support housing 52 and the parts associated therewith, may be assembled in an area removed from the trucks involved.

Another feature is that the subassembly including the lower support housing 52 and its associated parts may be held in place with the wheel axle unit 10 by having it screwed in place. It may of course be easily slid off the axle 10 by just unscrewing the lower support housing and sliding it off the axle.

An advantage of the types of pairs of springs 24 and 26 is that they may be designed to have very low shear stiffness because the springs employ rubber elements and steel plates which are not unstable but marginally stable so that when you move it up and down vertically or shear the control springs, they contribute very little to the vertical stiffness.

What is claimed is:

1. A railway truck including a wheel axle unit connected to a side frame through a primary suspension system including a sub-assembly detachable from said railway truck, said sub-assembly comprising:

(a) a journal bearing retainer for receiving a journal bearing connected to an axle of said wheel axle unit, said journal bearing retainer having two pairs of first angular portions at the ends thereof;

(b) a lower support housing connected to said journal bearing retainer and having two pairs of second angular portions;

(c) a pair of elastomeric vertical springs positioned side by side and each said elastomeric vertical spring having openings at opposite ends to receive locating pin elements connected to said journal bearing retainer and said side frame;

(d) two pairs of angularly spaced compressed spring elements disposed in a horizontal plane between the respective angular portions of said journal bearing retainer and said lower support housing for providing lateral and longitudinal spring controls in said primary suspension system;

(e) said pairs of compressed springs including positioning pins at the ends thereof disposed to fit into openings in the angular portions of said journal bearing retainer and said lower housing; and (f) screw means for securing said sub-assembly to said side frame of said railway truck and said journal bearing whereby said compressed spring elements remain in compressed condition between said first angular portions and said second angular portions after said sub-assembly is removed from said journal bearing and said side frame.

* * * * *